US006531671B2

(12) United States Patent
Yeh

(10) Patent No.: US 6,531,671 B2
(45) Date of Patent: Mar. 11, 2003

(54) MEMBRANE CIRCUIT BOARD SWITCH WITH A PRESSURE REGULATING RESERVOIR

(75) Inventor: Chi-Pin Yeh, Tai-Nan Hsien (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 09/803,885

(22) Filed: Mar. 13, 2001

(65) Prior Publication Data

US 2001/0025779 A1 Oct. 4, 2001

(30) Foreign Application Priority Data

Mar. 31, 2000 (TW) ..... 89106045 A

(51) Int. Cl.[7] ..... H01H 9/00

(52) U.S. Cl. ..... 200/515
(58) Field of Search ..... 200/515

(56) References Cited

U.S. PATENT DOCUMENTS 4,018,999 A * 4/1977 Robinson et al. ..... 200/515 X
4,345,119 A * 8/1982 Latasiewicz ..... 200/515 X
4,931,601 A * 6/1990 Lavender ..... 200/515 X

* cited by examiner

*Primary Examiner*—Renee Luebke
(74) *Attorney, Agent, or Firm*—Winston Hsu

(57) ABSTRACT

A membrane circuit board switch used in a keyboard for generating key-pressing signals. The membrane circuit board switch has an upper membrane circuit layer, a lower membrane circuit layer, and a plurality of switch units. Each switch unit has a predetermined space between the upper and lower membrane circuit layers. The membrane circuit board switch particularly has a pressure regulating reservoir communicating with the predetermined spaces. When atmospheric pressure changes, the pressure regulating reservoir will adjust the pressure inside the predetermined spaces to make the predetermined distance keeping substantially constant.

8 Claims, 7 Drawing Sheets

MEMBRANE CIRCUIT BOARD SWITCH WITH A PRESSURE REGULATING RESERVOIR

BACKGROUND OF THE INVENTION

1. Field of the Invention

The present invention relates to a membrane circuit board switch, and more particularly, to a membrane circuit board switch with a pressure regulating reservoir.

2. Description of the Prior Art

Please refer to FIG. 1 and FIG. 2. FIG. 1 is a schematic diagram of a prior art membrane circuit board switch 10 used in a keyboard 12. FIG. 2 is a schematic diagram of a switch unit 32 of the membrane circuit board switch 10 shown in FIG. 1. The membrane circuit board switch 10 is used in the keyboard 12 for generating key-pressing signals. The keyboard 12 comprises a base plate 14, and a plurality of key mechanisms 16. The membrane circuit board switch 10 is installed between the base plate 14 and the plurality of key mechanisms 16. The membrane circuit board switch 10 comprises an upper membrane circuit 18, a lower membrane circuit 22, and a plurality of switch units 32. The upper membrane circuit 18 comprises a plurality of upper contacts 20. The lower membrane circuit 22 comprises a plurality of lower contacts 24 that correspond to the upper contacts 20. Each upper contact 20 and its corresponding lower contact 24 form a switch unit 32.

As shown in FIG. 2, the key mechanism 16 is up-and-down movably installed above the switch unit 32 for pressing the upper contact 20 to contact the lower contact 24 to generate a corresponding key-pressing signal. The lower membrane circuit 22 is positioned under the upper membrane circuit 18. There is an interval material layered between the upper and lower membrane circuit layers for forming a predetermined space 28 with a predetermined distance 30 between the upper and lower contacts 20, 24. When the key mechanism 16 is depressed, the upper contact 20 is pressed down to contact the lower contact 24. When the key mechanism 16 is released, or not depressed, the upper contact 20 will revert, or maintain the predetermined distance 30 from the corresponding lower contact 24.

Please refer to FIG. 3 and FIG. 4. FIG. 3 depicts a state of the switch unit 32 shown in FIG. 1 with lower atmospheric pressure. FIG. 4 depicts a state of the switch unit 32 shown in FIG. 1 with higher atmospheric pressure. Generally, there are 2 design choices of the said predetermined space 28: interacting with the atmosphere or not. To keep unwanted particles (dust, steam etc.) out of the predetermined space 28, the latter is usually chosen. However, when atmospheric pressure changes, the hermetic design of the predetermined space 28 can lead to malfunctioning of the switch unit 32. As show in FIG. 3, when the atmospheric pressure drops (this may occur due to a change of height or temperature), the pressure inside the predetermined space 28 is higher than the atmospheric pressure. Therefore, it is not easy to make the upper contact 20 to contact the lower contact 24. Furthermore, as shown in FIG. 4, when the atmospheric pressure rises, the pressure inside the predetermined space 28 becomes lower than the atmospheric pressure. Therefore, the upper contact 20 may not maintain the predetermined distance from the lower contact 24, and thus makes unexpected contact with the lower contact 24.

SUMMARY OF THE INVENTION

It is therefore a primary objective of the present invention to provide a membrane circuit board switch with a pressure regulating reservoir to solve the mention problems.

The present invention, briefly summarized, discloses a membrane circuit board switch used in a keyboard. The keyboard comprises a base plate, and at least one key mechanism. The membrane circuit board switch is installed between the base plate and the key mechanism. The membrane circuit board switch comprises an upper membrane circuit layer, a lower membrane circuit layer, and at least one pressure regulating reservoir communicates with the membrane circuit board switch. The upper membrane circuit layer comprises at least one upper contact. The lower membrane circuit layer comprises a corresponding lower contact. A predetermined space is formed with a predetermined distance between the upper and lower contacts by an interval material. The key mechanism can press the upper contact to contact the lower contact to generate a corresponding key-pressing signal. The pressure regulating reservoir communicates with the predetermined space to adjust the pressure inside the predetermined space. When the atmospheric pressure changes, the volume of the pressure regulating reservoir will adjust the pressure inside the predetermined space to make the predetermined distance keeping substantially constant.

It is an advantage of the present invention that the membrane circuit board switch prevents particles from entering the predetermined space, and it also adjusts the pressure inside the predetermined space to adapt to the changes of atmospheric pressure.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
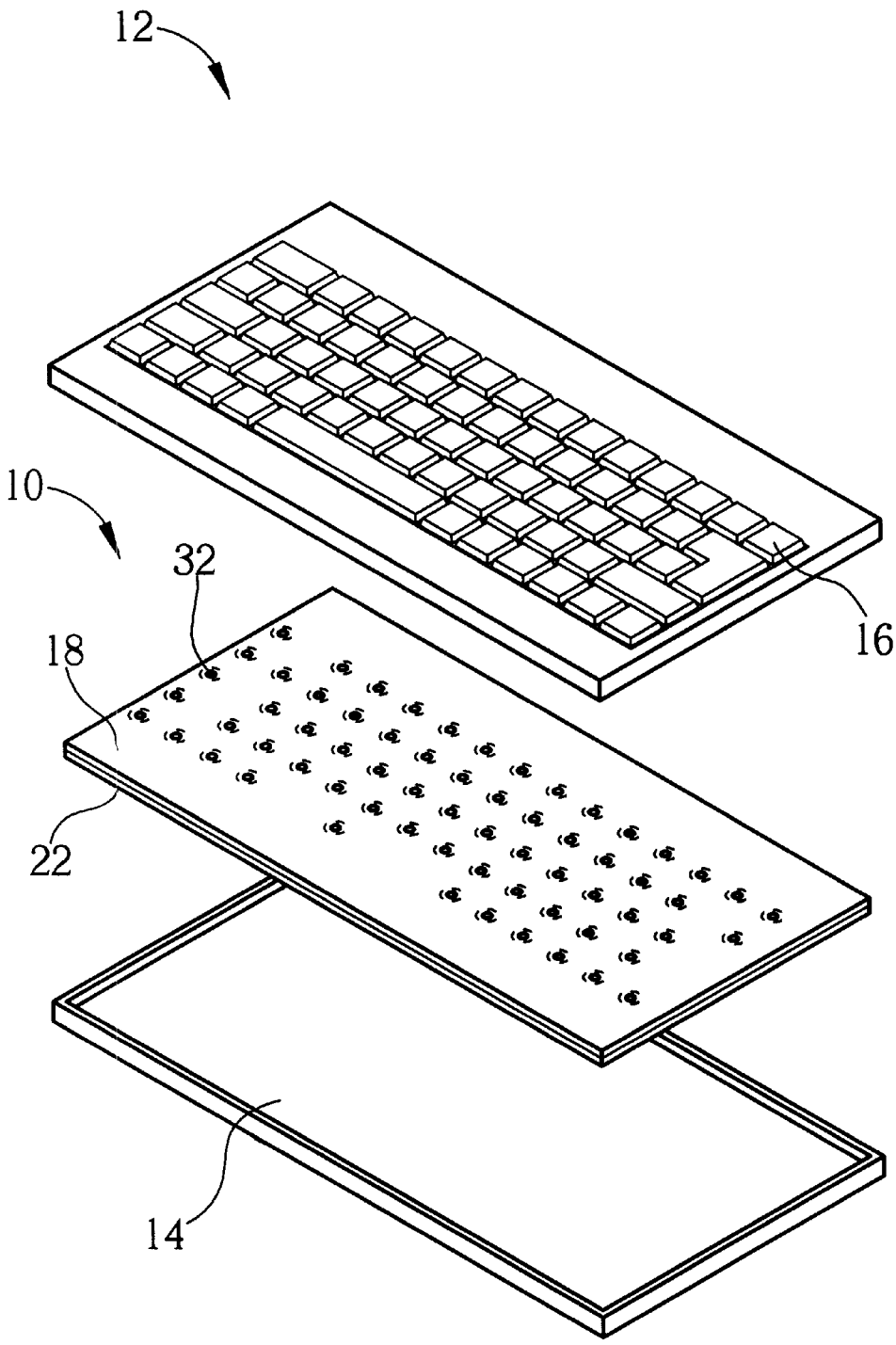
Fig.1 Prior art
FIG. 1 is a schematic diagram of a prior art membrane circuit board switch used in a computer keyboard.
Figure 2:
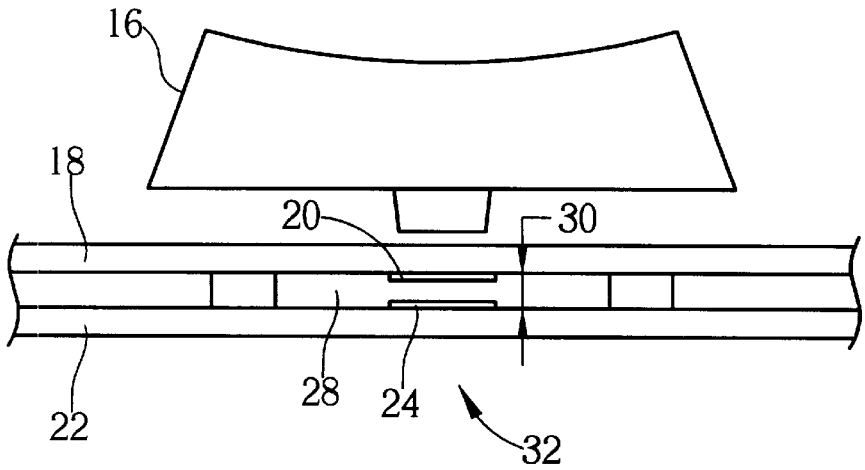
Fig. 2 Prior art
FIG. 2 is a schematic diagram of a switch unit of the membrane circuit board switch shown in FIG. 1.
Figure 3:
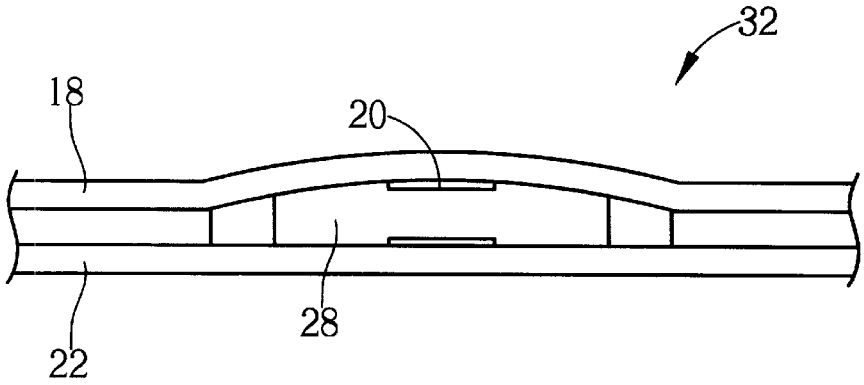
Fig. 3 Prior art
FIG. 3 depicts a state of the switch unit shown in FIG. 1 under a lower atmospheric pressure.
Figure 4:
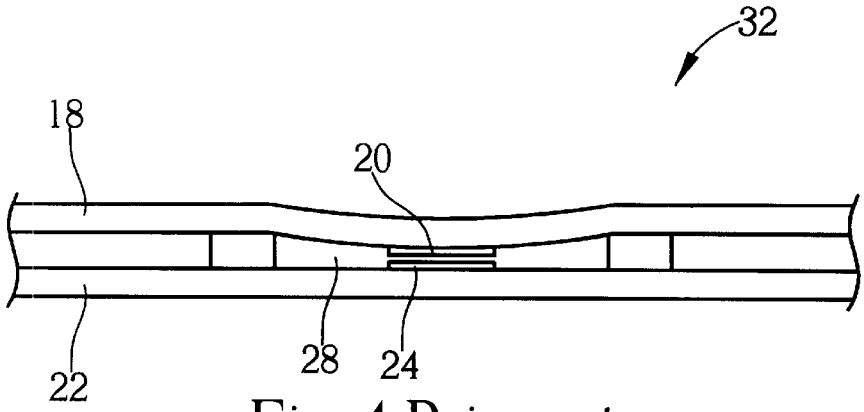
Fig. 4 Prior art
FIG. 4 depicts a state of the switch unit shown in FIG. 1 under a higher atmospheric pressure.
Figure 5:
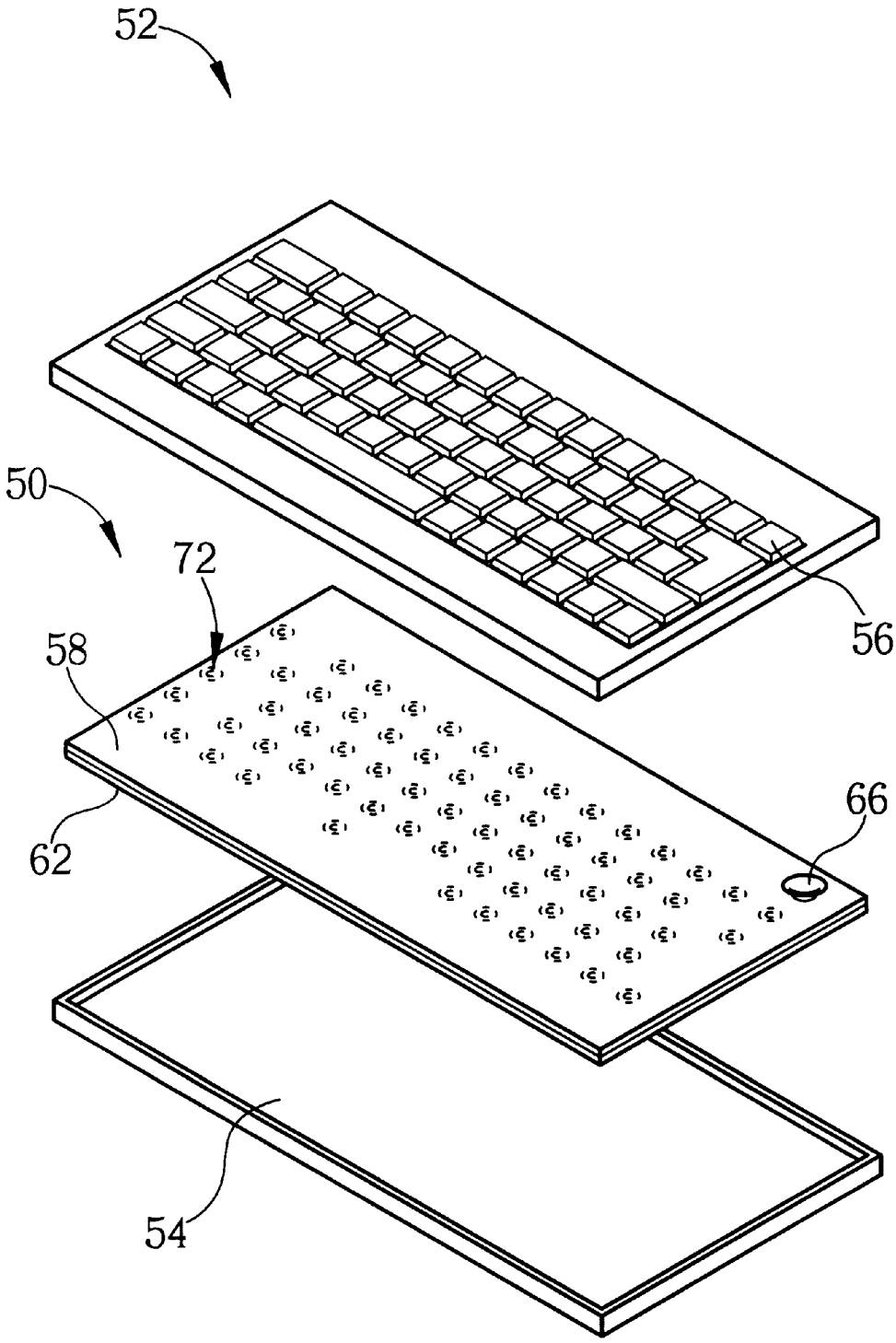
FIG. 5 is a schematic diagram of a membrane circuit board switch used in a keyboard according to the present invention.
Figure 6:
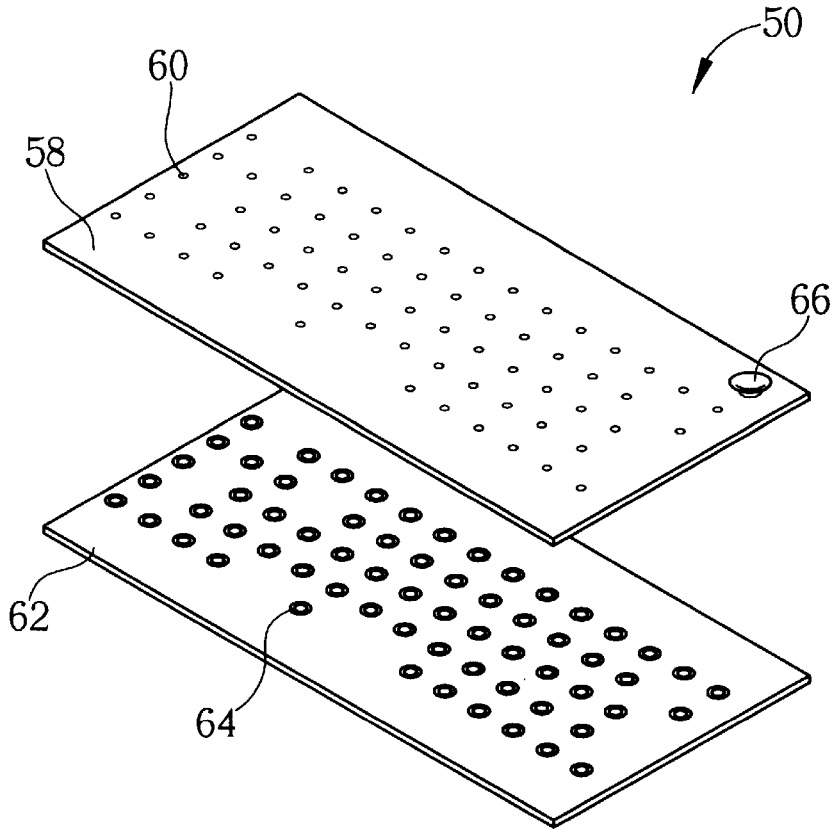
FIG. 6 is an exploded view of the membrane circuit board switch shown in FIG. 5.

Please refer to FIG. 5 and FIG. 6. FIG. 5 is a schematic diagram of a membrane circuit board switch 50 used in a keyboard 52 according to the present invention. FIG. 6 is an exploded view of the membrane circuit board switch 50 shown in FIG. 5. The membrane circuit board switch 50 is used in the keyboard 52 for generating key-pressing signals. The keyboard 52 comprises a base plate 54, and a plurality of key mechanisms 56. The membrane circuit board switch 50 is installed between the base plate 54 and the plurality of key mechanisms 56. The membrane circuit board switch 50 comprises an upper membrane circuit layer 58, a lower membrane circuit layer 62, and at least one pressure regulating reservoir 66 communicated with the membrane circuit board switch 50.

Figure 6A:
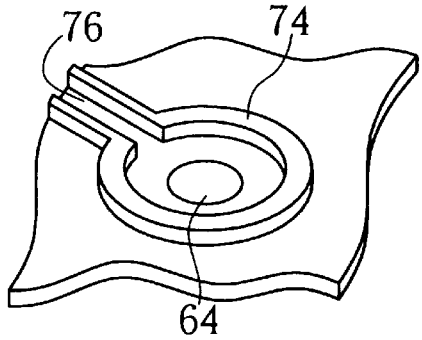

Please refer to FIG. 6 and FIG. 6*a*. The upper membrane circuit layer 58 comprises a plurality of upper contacts 60. The lower membrane circuit layer 62 comprises a plurality of lower contacts 64 that correspond to the upper contacts 60. The membrane circuit board switch 50 further comprises a printed layer 74 around the upper and lower contacts 60, 64 and between the upper and lower membrane circuit layers 58, 62. The lower membrane circuit layer 62 is positioned under the upper membrane circuit layer 58. The upper and lower membrane circuit layer 58, 62 are glued to each other. Each upper contact 60 and its corresponding lower contact 64 form a switch unit 72.

Figure 7:
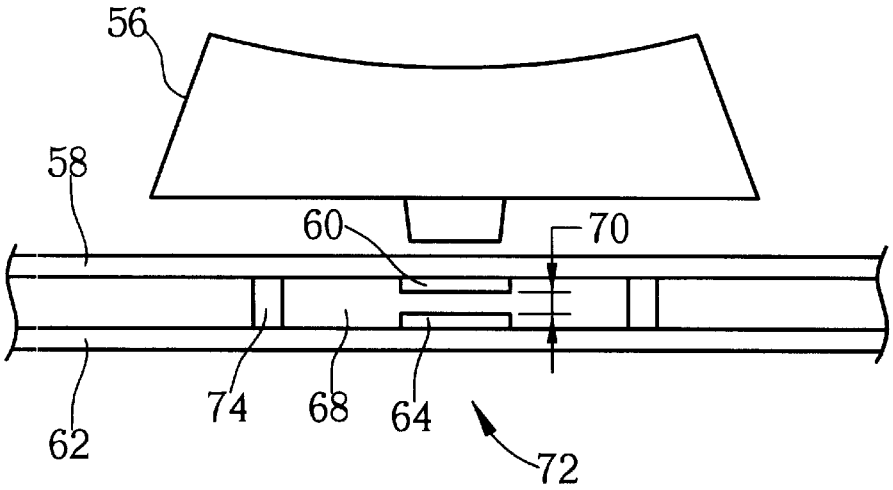
FIG. 7 is a schematic diagram of the switch unit shown in FIG. 5.

Please refer to FIG. 7. FIG. 7 is a schematic diagram of the switch unit 72 shown in FIG. 5. The switch unit 72 is formed from corresponding upper and lower contacts 60, 64. The key mechanism 56 is up-and-down movably installed above the switch unit 72 for pressing the upper contact 60 to contact the lower contact 64 to generate a corresponding key-pressing signal. Because of the printed layer 74 between the upper and lower membrane circuit layers 58, 62, a predetermined space 68 is formed with a predetermined distance 70 between the upper and lower contacts 60, 64. When the key mechanism 56 is depressed, the upper contact 60 will be pressed downward to contact the lower contact 64. When the key mechanism 56 is released, or not depressed, the upper contact 60 will revert, or maintain the predetermined distance 70 from the corresponding lower contact 64.

Figure 8:
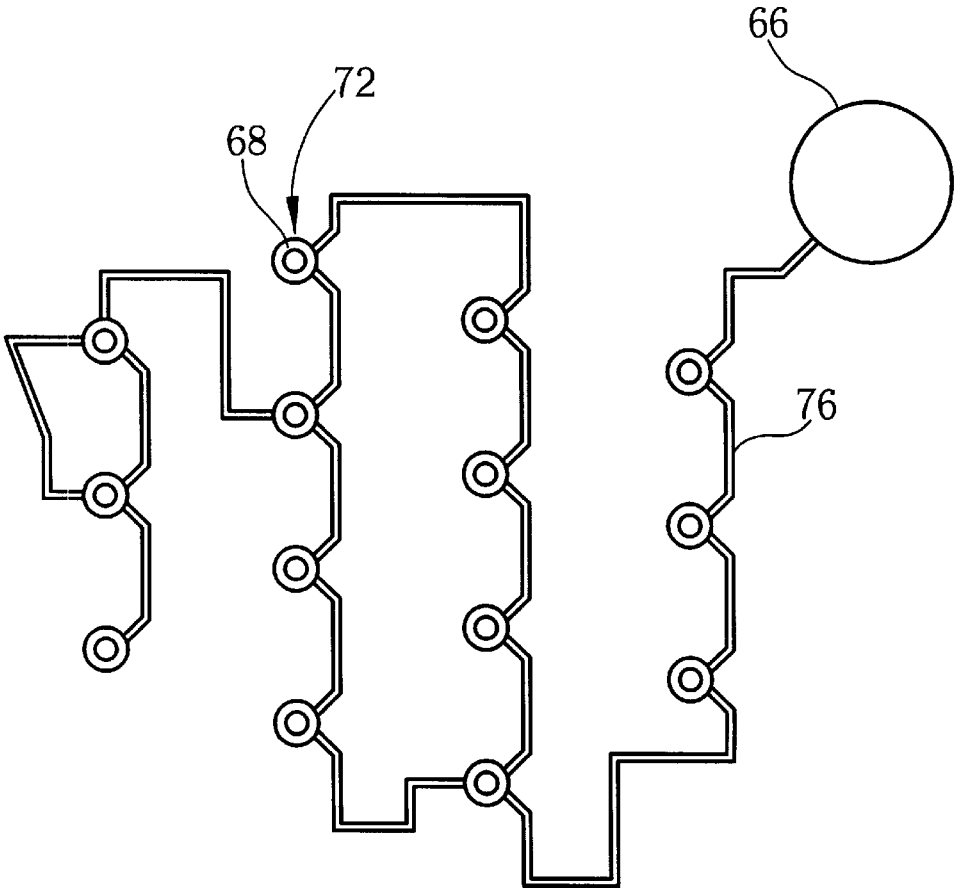
FIG. 8 depicts a pressure regulating reservoir communicating with a predetermined space shown in FIG. 5.

Please refer to FIG. 8. FIG. 8 depicts the pressure regulating reservoir 66 communicating with the predetermined space 68 shown in FIG. 5. The membrane circuit board switch 50 further comprises a plurality of air conduits 76 between the upper and lower membrane circuit layers 58, 62. The air conduits 76 connect the predetermined spaces 68 with each other and the pressure regulating reservoir 66 so that each predetermined space 68 communicates with the pressure regulating reservoir 66. The pressure regulating reservoir 66, the predetermined spaces 68, and the air conduits 76 are communicated with each other and formed a close space that insulated from the atmosphere. The volume of the pressure regulating reservoir 66 is larger than the sum of the volumes of the predetermined spaces 68 and the air conduits 76. The pressure regulating reservoir 66 can be a plastic bag, a soft rubber bag, or an extensible bag, as long as the volume of the pressure regulating reservoir is easier changed than the predetermined spaces.

Figure 9:
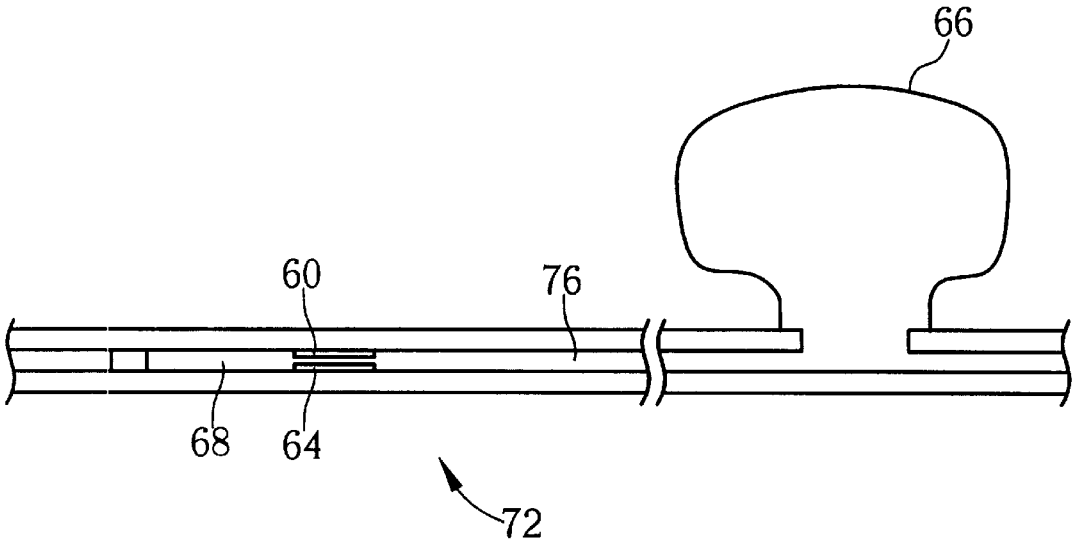
FIG. 9 depicts a state of the pressure regulating reservoir shown in FIG. 5 under lower atmospheric pressure.
Figure 10:
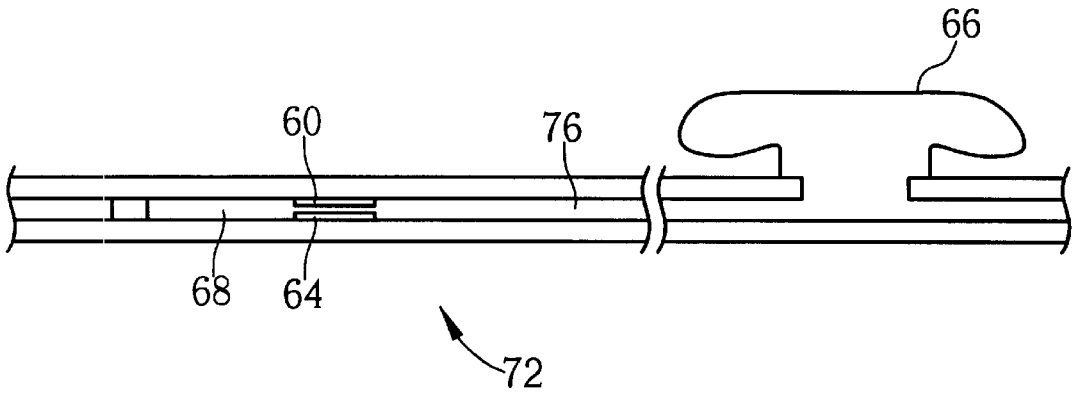
FIG. 10 depicts a state of the pressure regulating reservoir shown in FIG. 5 under higher atmospheric pressure.

Please refer to FIG. 9 and FIG. 10. FIG. 9 depicts a state of the pressure regulating reservoir 66 shown in FIG. 5 under lower atmospheric pressure. FIG. 10 depicts a state of the pressure regulating reservoir 66 shown in FIG. 5 under higher atmospheric pressure. When the atmospheric pressure changes, the volume of the pressure regulating reservoir 66 will change with the atmospheric pressure to adjust the pressure inside the predetermined space 68. Consequently, the upper contact 60 maintains the predetermined distance 70 from the lower contact 64. The key mechanism 56 can thus press the upper contact 60 and cause the upper contact 60 to contact with the lower contact 64.

As shown in FIG. 9, the predetermined space 68 communicates with the pressure regulating reservoir 66 through the air conduits 76. When the atmospheric pressure drops, the volume of the pressure regulating reservoir 66 will increase, thus decreasing the pressure inside the predetermined space 68 until the pressure inside the predetermined space 68 is equal, or nearly so, to the atmospheric pressure. After adjusting for the pressure inside the predetermined space 68, the key mechanism 56 can easily press the upper contact 60 to contact with the lower contact 64.

As shown in FIG. 10, when the atmospheric pressure rises, the volume of the pressure regulating reservoir 66 will decrease, thus increasing the pressure inside the predetermined space 68 until the pressure inside the predetermined space 68 is equal, or nearly so, to the atmospheric pressure. After adjusting for the pressure inside the predetermined space 68, the upper contact 60 maintains the predetermined distance 70 from the lower contact 64, and the said malfunctioning problem will not occur.

Figure 11:
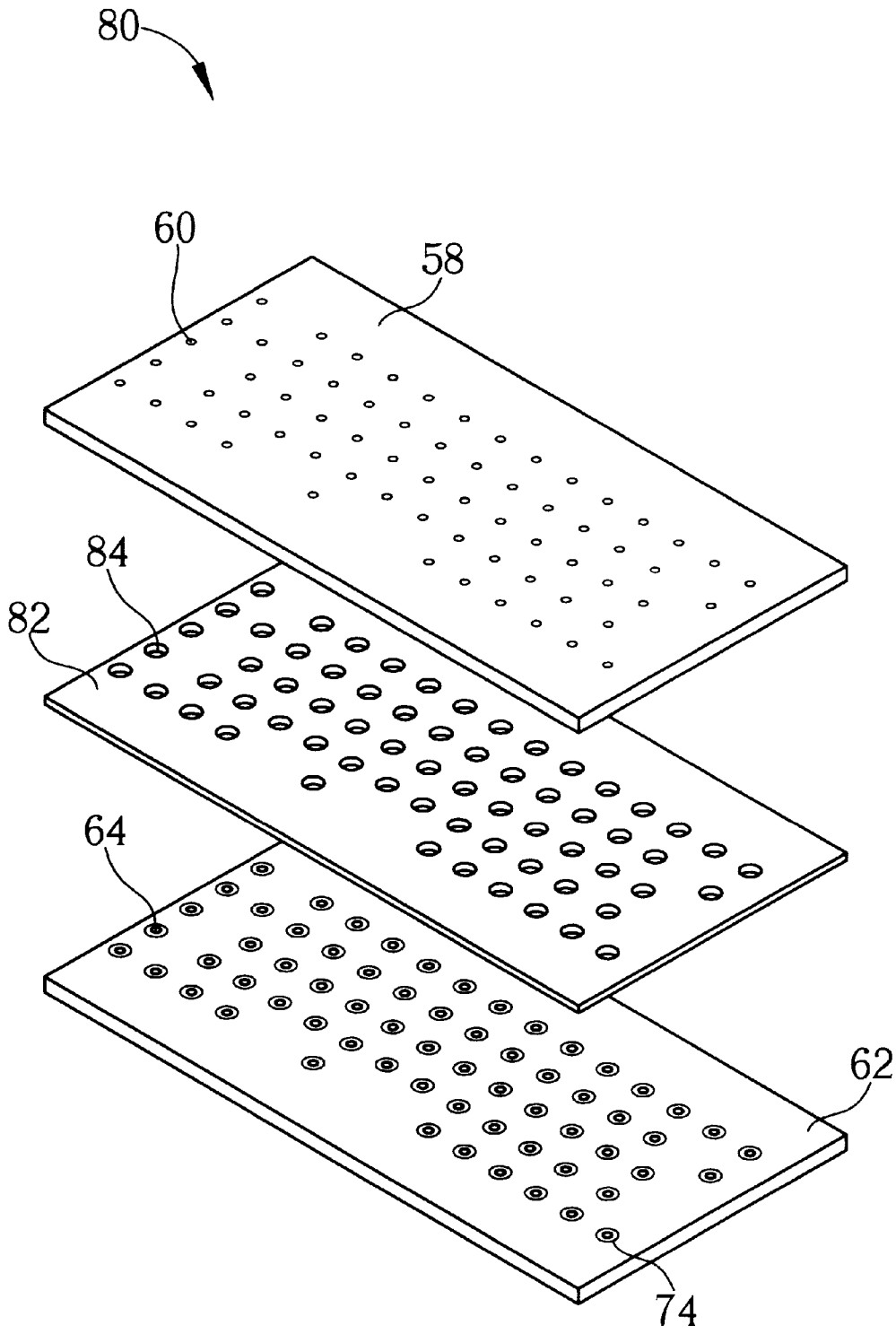
FIG. 11 is an exploded view of another embodiment of a membrane circuit board switch according to the present invention.

Please refer to FIG. 11. FIG. 11 is an exploded view of the second embodiment of the present invention, a membrane circuit board switch 80. The main difference between the membrane circuit board switches 50, 80 is the manner of forming the predetermined space 68. The predetermined space 68 of the membrane circuit board switch 50 is formed by the printed layer 74. The predetermined space 68 of the membrane circuit board switch 80, however, is formed by a middle layer 82. The middle layer 82 is installed between the upper and lower membrane circuit layers 58, 62, and comprises a plurality of holes 84 that correspond to the upper and lower contacts 60, 64 for forming the predetermined space 68. The air conduits 76 can be formed between the upper membrane circuit layer 58 and the middle layer 82, or between the lower membrane circuit layer 62 and the middle layer 82 by the printed layer.

In contrast to the prior art, the present invention has the pressure regulating reservoir 66 and the air conduits 76 that connect the predetermined spaces 68 with the pressure regulating reservoir 66. When the atmospheric pressure changes, the pressure regulating reservoir 66 will adjust the pressure inside the predetermined spaces 68 so that the key mechanisms 56 can easily press the upper contact 60 to contact with the lower contact 64. The pressure regulating reservoir 66 also ensures that the upper contact 60 maintains the predetermined distance 70 from the lower contact 64. Furthermore, because the pressure regulating reservoir 66, the predetermined spaces 68, and the air conduits 76 according to the present invention are communicated with each other and formed a close space that insulated from the atmosphere, the present invention also prevents unwanted particles from entering into the predetermined space 68.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A membrane circuit board switch comprising:

an upper membrane circuit layer having an upper contact;

a lower membrane circuit layer positioned under the upper membrane circuit layer, the lower membrane circuit layer having a lower contact corresponding to the upper contact, and a predetermined space formed between the upper membrane circuit layer and the lower membrane circuit layer; and a pressure regulating reservoir communicated with the predetermined space through an air conduit;

wherein the predetermined space, the air conduit, and the pressure regulating reservoir are insulated from the atmosphere;

wherein the volume of the pressure regulating reservoir is easier changed than the predetermined space, so the pressure regulating reservoir adjusts the pressure inside the predetermined space when the atmospheric pressure changes.

2. The membrane circuit board switch of claim 1 wherein the pressure regulating reservoir is a plastic bag.

3. The membrane circuit board switch of claim 1 wherein the pressure regulating reservoir is a soft rubber bag.

4. The membrane circuit board switch of claim 1 wherein the pressure regulating reservoir is an extensible bag.

5. The membrane circuit board switch of claim 1 wherein the volume of the pressure regulating reservoir is larger than the sum of the volumes of the predetermined space and the air conduit.

6. The membrane circuit board switch of claim 1 further comprising a printed layer installed between the upper and lower membrane circuit layers and around the upper and lower contacts so as to form the predetermined space.

7. The membrane circuit board switch of claim 1 further comprising a middle layer installed between the upper and lower membrane circuit layers, the middle layer comprising a hole that corresponds to the upper and lower contacts for forming the predetermined space.

8. The membrane circuit board switch of claim 1 wherein the upper and lower membrane circuit layers are glued to each other.

* * * * *